United States Patent [19]

Oly

[11] Patent Number: 4,924,653

[45] Date of Patent: May 15, 1990

[54] APPARATUS FOR METERING A FOIL WEB FOR WRAPPING OBJECTS SUPPLIED ALONG A HORIZONTAL SUPPORT

[75] Inventor: Pieter J. Oly, Wormer, Netherlands

[73] Assignee: Sollas Holland B.V., Netherlands

[21] Appl. No.: 266,118

[22] Filed: Nov. 2, 1988

[30] Foreign Application Priority Data

Nov. 3, 1987 [NL] Netherlands ..... 8702623

[51] Int. Cl.[5] ..... B65B 57/02; B65B 11/06; B65B 41/16

[52] U.S. Cl. ..... 53/66; 53/228; 53/389

[58] Field of Search ..... 53/66, 228, 229, 230, 53/231, 232, 389

[56] References Cited

U.S. PATENT DOCUMENTS

| | | | |
|---|---|---|---|
| 2,894,363 | 7/1959 | Voogd | 53/228 |
| 3,277,630 | 11/1966 | Youngman et al. | 53/228 X |
| 3,306,003 | 2/1967 | Sundy et al. | 53/228 X |
| 4,217,744 | 8/1980 | Mizutani | 53/389 X |

FOREIGN PATENT DOCUMENTS

| | | |
|---|---|---|
| 2544705 | 6/1976 | Fed. Rep. of Germany . |
| 7711799 | 10/1977 | Netherlands . |
| 1086789 | 9/1966 | United Kingdom . |

*Primary Examiner*—Robert L. Spruill
*Assistant Examiner*—Linda B. Johnson
*Attorney, Agent, or Firm*—Kenyon & Kenyon

[57] ABSTRACT

An apparatus for metering a foil web (5) extending vertically downwards through the path of movement (1) of objects (2) to be wrapped thereby the free cutting tool being arranged above said path (1) allowing to cut off the metered web (5''). Between the supply roll (4) and the cutting tool (10), a metering roller pair (7) is arranged, is coupled with a drive means (8) adapted to be adjusted to a desired web length (5''), and beyond said cutting tool (10), a gripping assembly (11 . . . 16) for the free end of the foil web (5') supplied by the metering roller pair (7) is arranged which is movable vertically downwards from a starting position with the supply speed of said web, and is adapted to grip the free end of said web (5'') with some friction, said friction being so that, when interrupting the supply by the metering roller pair (7), this end is released, the length of the path of movement of said gripping assembly (11 . . . 16) corresponding with the largest web length (5'') to be metered, said assembly being adapted to be returned to the starting position before the supply of the next foil web (5') begins. In particular the gripping assembly comprises two pairs of endless chains (**14*a*, 14*b*) or the like being guided over an upper and a lower reversing wheel (13), said pairs being arranged at both sides of the path of the foil web (5'') to be metered, transverse rods (16*a*, 16*b*) being arranged which are provided with friction parts, which rods (16) of different pairs gripping the free end of an intermediate foil web (5'**).

5 Claims, 1 Drawing Sheet

Figures 1, 2:
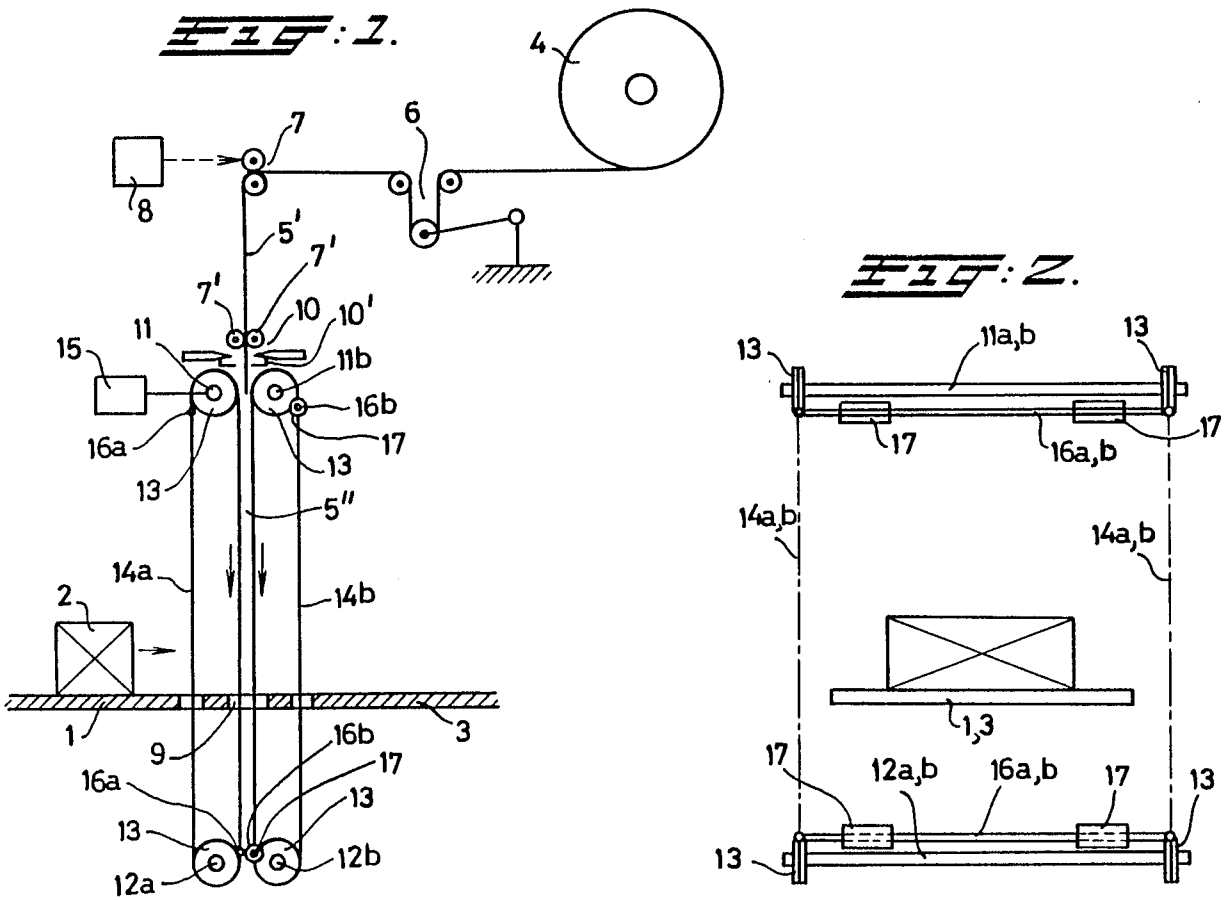

1
2
3
4
5'
5''
6
7
7'
8
9
10
10'
11
11a,b
11b
12a
12a,b
12b
13
14a
14a,b
14b
15
16a
16a,b
16b
17
1,3

APPARATUS FOR METERING A FOIL WEB FOR WRAPPING OBJECTS SUPPLIED ALONG A HORIZONTAL SUPPORT

The invention relates to an apparatus for metering a foil web for wrapping objects supplied along a horizontal support, which foil web is uncoiled from a supply roll and extends vertically downwards through the path of movement of the objects, the free end of the foil web being situated below said path, so that during movement of an object said web will be taken along, a cutting tool being arranged above said path allowing to cut off the metered web, said object then being discharged towards an adjoining apparatus for folding and sealing the foil wrapping.

In the known apparatus of this kind, the uncoiled foil web is freely suspended in the path of the object to be wrapped. A draw-back thereof is that the foil must drop under its own weight downwards. If large objects are to be wrapped, said web should be longer accordingly, and it is difficult then to lower the web sufficiently fast if the objects are supplied in a faster succession, which is desirable in view of an efficient use of the wrapping device of which this apparatus is a part.

It is an object of the invention to provide an apparatus not showing this draw-back, and that, to that end, is characterised in that, between the supply roll and the cutting tool, a metering roller pair is arranged, between which the foil material to be metered is led, which roller pair is coupled with a drive means adapted to be adjusted to a desired web length, and in that, beyond said cutting tool, a gripping assembly for the free end of the foil web supplied by the metering roller pair is arranged which is movable vertically downwards from a starting position with the supply speed of said web, and is adapted to grip the free end of said web with some friction, said friction being so that, when interrupting the supply by the metering roller pair, this end is released, the length of the path of movement of said gripping assembly corresponding with the largest web length to be metered, said assembly being adapted to be returned to the starting position before the supply of the next foil web begins.

Since, now, the free end of the web is pulled downwards, and the weight of the web plays no longer a role, the supply speed can be increased, and the transfer of objects to be wrapped, even if having large dimensions, can be accelerated, so that the efficiency of the device can be improved.

In particular the gripping assembly can comprise two pairs of vertically directed endless chains or the like, each being guided over an upper and a lower reversing wheel, said pairs being arranged at both sides of the path of the foil web to be metered, the chains of each pair each having a flight being situated at a small distance of a flight of the other chain of said pair, said flights being adapted to be driven in the same sense and with a velocity which is substantially equal to the supply velocity of the foil web, in that, between two chains of different pairs situated at the same side of the foil web path, transverse rods are arranged which are provided with friction parts, which rods of different pairs, when driving said chains, will be pair-wise oppositely positioned in such a manner, that the free end of an intermediate foil web can be gripped thereby, in that the length of the flights of these chains is at least equal to the largest web length to be metered, and in that the driving means of said chains is coupled with said metering roller pair in such a manner that, at the beginning of the foil web supply by this roller pair, the transverse rods will again be positioned in the starting position.

The use of chains or the like simplifies returning said friction parts, and the friction clamp allows to use a clamp which will always be displaced over the same distance, the active stroke thereof only being determined by the metering rollers. Chains driven by sprockets provide an accurate synchronisation of both transverse rods of these chains.

The operation can still be improved if each pair of chains is provided with two or more transverse rods, and this in such a manner, that, when one set of transverse rods is positioned at the end of the pulling stroke in the lowest position, another set will be in the starting position. Returning one clamp will, then, take place during the operative stroke of another one.

In particular such chains are provided with sensors which, as soon as one set of transverse rods has reached the starting position, can interrupt the drive of said chains, said drive being started again as soon as a signal of the metering roller pair has been received. In order to guide a foil web unambiguously towards the cutting tool, preferably an additional driven roller pair will be provided which is arranged near the cutting tool, and said cutting tool can, moreover, be provided with a friction clamp adapted to retain the cut-off portion with some friction until this portion will be dragged along with the object to be wrapped.

Since, for measuring suitable web lengths, also the cutting tool is to be moved, preferably the gripping assembly is made vertically movable together with this cutting tool.

The invention will be elucidated below in more detail by reference to a drawing, showing in:

FIG. 1 a highly simplified representation of a device for wrapping objects with foil, provided with the apparatus according to the invention; and FIG. 2 a lateral view of said apparatus as seen in the direction of displacement of the objects to be wrapped.

In FIG. 1 a portion of a foil wrapping device is shown in a highly simplified manner. This device comprises a supply path 1 for objects 2 to be wrapped, as well as a discharge path 3 aligned with the former path, said discharge path being provided with means not shown for folding and sealing the wrapping foil.

The foil material is present on a dispensing roll 4, a web 5 thereof being guided over a tensioning roller 6 towards a supply roller pair 7. This roller pair 7 is coupled with a controllable drive means 8, adapted to move always a pre-adjusted length of the web 5 between the rollers 7.

Beyond the rollers 7 the web portion 5' hangs vertically downwards, namely above an interruption 9 between the conveying paths 1 and 3 for the objects 2. It is the intention to move the unwound web length 5'' so far beyond the plane of said paths 1 and 3 through the passage 9, that an object 2 pushed towards the right will drag along the foil web, after the latter has been cut off by a cutting tool 10.

In order to guide the foil web portion 5' efficiently and quickly through the passage 9 without being disturbed by air flows, a transverse assembly is provided.

This assembly comprises two upper shafts **11*a* and 11*b* at both sides of the web 5'', and two lower shafts 12*a* and 12*b*, also at both sides of the web 5'', the upper shafts being arranged near the cutting tool 10, and the lower shafts 12 being situated at some distance below the plane of the conveying paths 1 and 3. Said shafts carry, at their extremities, chains prockets 13 over which chains 14***a* and 14*b* resp. are guided, which chains extend parallel to the foil web 5". A drive means schematically indicated at 15 is adapted to drive said chains 14 in the sense indicated by arrows, the flights thereof which are nearest to the path 5" moving downwards.

Between the chains 14*a* and 14*b* transverse rods 16*a* and 16*b* resp., are arranged. In the case shown, each pair of chains is provided with two rods 16, the starting position thereof being shown, in which, for each chain pair, one rod is situated near the upper sprockets, and the other one near the lower sprockets. The web 5' is, then, situated above the upper sprockets 13.

As soon as the supply rollers 7 begin to turn, the end of the web portion 5' moves downwards between the upper sprockets 13. At the same time the chains 14 begin to move, and this in such a manner, that two rods 16*a* and 16*b* are simultaneously moved over the upper sprockets, and will then be able to grip the end of the web portion 5' which has, in the meantime, been lowered between the shafts 11*a* and 11*b*. One rod 16*b*, for instance, is provided with rollers 17 of rubber or plastics, pressing the end of the foil web against the other rod 16*a*. Chain drive takes place with a velocity which is equal to the velocity at which the web portion 5' is supplied by the rollers 7.

The drive means 8 for the rollers is adjusted in such a manner that a web length is dispensed corresponding to the length required for wrapping an object 2. The distance between the shafts 11 and 12 is, then, so that the displacement of the rods 16 by means of the chains 14 between the upper and lower point is at least equal to the largest web length met with.

In the case of a smaller web length dispensed by the rollers 7, the supply of the foil web portion 5' is stopped before the rods 16 have reached their lower position. The friction by which said rods or rollers 17 provided thereon grip the foil web portion 5', or, in the case of rotatable rods 16 and/or rollers 17 the friction of rotation of said rollers, has been chosen so that said rods then release the foil web, and will move onwards towards the end of their path.

When the rods 16*a* and 16*b*, which, in the starting position shown, are situated at the upper side, move downwards, both other rods 16*a* and 16*b* will move upwards, so that the latter, eventually, will reach the upper position shown. On that moment the chain drive 14 is interrupted. This movement is started again as soon as the rollers 7 are enabled to dispense a new foil web portion. Moreover the cutting tool 10 has been operated in order to cut loose the dispensed foil web portion.

In this manner it is ensured that the dispensed foil web portion will always be kept taut, and no time is lost for returning the gripping rods, since a second set thereof will be always present then in the starting position, and can be activated again immediately. Thereby a very fast movement of the foil web can be obtained without being hindered by air flows or the like.

Since, when wrapping larger objects, the web required therefore should not only hang farther below the conveying surface 1, 3, but also should be cut at the larger distance therefrom, the position of the cutting tool 10 should be adapted thereto. In order to ensure a correct supply between the gripping rods 16, preferably the assembly of sprockets chains is mounted on a carriage coupled with the cutting tool 10, and adapted to move together therewith upwards or downwards.

The control of the drive means 15 for the chains 14 can, for instance, be made so that the drive will be switched on by a signal produced by drive means 8 for the rollers 7 when being switched on, for instance at the moment that a sensor detects the approach of an object 2. The drive means 15 can be switched off again as soon as a sensor has detected that a rod pair 16 has reached the starting position. In particular the downward velocity of the rods 16 should then be equal to the supply velocity of the web 5 provided by the rollers 7. This velocity is, in particular, adjustable in order to obtain an adaptation thereof to the supply of the objects 2 and/or to the web length to be dispensed.

In order to ensure that the web portion 5' will be guided unambiguously towards the cutting tool 10, preferably an additional driven roller pair 7' is provided supporting the web portion 5' supplied by the rollers 7 in the correct position in the vicinity of the tool 10. This tool can be provided then with a friction clamp 10' retaining the cut-off extremity of the web portion 5" until that portion 5" has been taken along by the object 2.

I claim:

1. An apparatus for metering sheet material lengths to be wrapped around objects moving along a substantially horizontal supporting means, comprising:

a sheet material supply roll;

dispensing means for uncoiling the sheet material from the supply roll;

the sheet material having a free edge;

said dispensing means comprising driving means and metering rollers;

said metering rollers engaging the supply roll and being coupled with said driving means in such a manner that the driving action thereof is stopped after a given number of revolutions of said rollers which corresponds with a desired length of dispensed sheet material;

vertically movable guiding means for the sheet material, said guiding means being provided with gripping means adapted to frictionally engage the free edge of the sheet material;

the frictional engagement between said guiding means and the sheet material being such that the frictional engagement is released as soon as said drive means has been stopped;

the path of movement of said guiding means extending through a passage in said horizontal supporting means;

said guiding means being coupled with a driving means adapted to move said guiding means from an initial upper position above said supporting means downwards over a fixed distance towards a lower position below said supporting means, and to return said guiding means to said initial position; and cutting means arranged between said metering rollers and the upper position of said guiding means;

said cutting means adapted to sever the sheet material portion below said cutting means from the remaining portion thereof.

2. The apparatus of claim 1 wherein said guiding means comprises:

two pairs of substantially parrallel endless chains being guided over a pair of upper and lower wheels and having two pairs of transverse rods connected equidistantly from one another along said endless chains so that when one pair of transverse rods is in a first upper starting position corresponding to the position of the upper wheels, the second pair of transverse rods is in a second lower ending position corresponding to the position of the lower wheels;

said chains being arranged at both sides of the path of the sheet material to be metered;

said transverse rods being positioned on each side of the sheet material to be metered and having friction means for frictionally engaging the sheet material passing therebetween;

the positioning of said transverse rods resulting in said friction means being oppositely positioned in such a manner that when said rods are in said first upper position the free end of the sheet material can be gripped thereby;

the length of chain corresponding to the distance between said upper and lower wheels equivalent to at least the largest sheet material length to be metered; and the movement of said chains corresponding to the movement of the sheet material as the sheet material passes between said transverse rods.

3. The apparatus of claim 2 wherein the chains are provided with sensors which, as soon as one set of transverse rods has reached the first upper starting position, can interrupt the drive of said chains, said drive being started again as soon as a signal from said metering roller pair has been received.

4. The apparatus of claim 1 wherein said cutting means is provided with a friction clamp for frictionally retaining the sheet material portion below said cutting means.

5. The apparatus of claim 1 wherein said gripping means is vertically adjustable together with said cutting tool.

* * * * *